United States Patent [19]

Kraus

[11] 4,101,694

[45] Jul. 18, 1978

[54] WOOD FINISHING PROCESS

[76] Inventor: Wayne A. Kraus, 2224 Ogden Ave., Cornwells Heights, Pa. 19020

[21] Appl. No.: 807,974

[22] Filed: Jun. 20, 1977

[51] Int. Cl.[2] ..... B05D 7/18; B05D 1/36; B05D 7/16

[52] U.S. Cl. ..... 427/399; 427/393; 427/408

[58] Field of Search ..... 427/393, 394, 408

[56] References Cited

U.S. PATENT DOCUMENTS

| | | | |
|---|---|---|---|
| 2,734,831 | 2/1956 | Larrson | 427/408 X |
| 3,017,287 | 1/1962 | Berry et al. | 427/408 X |
| 3,070,458 | 12/1962 | Berry | 427/408 X |
| 3,080,257 | 3/1963 | Berry | 427/408 X |
| 3,087,835 | 4/1963 | Aver | 427/393 X |
| 3,479,197 | 11/1969 | Mork | 427/408 X |

FOREIGN PATENT DOCUMENTS

| | | | |
|---|---|---|---|
| 516,350 | 9/1955 | Canada | 427/408 |

OTHER PUBLICATIONS

DuPont Bulletin NC-1168, "Nitrocellulose Barrier Coatings For Polystyrene".

Parker, "Principles of Surface Coating Technology", p. 674.

Hand, "How To Do Your Own Wood Finishing", pp. 102-106.

*Primary Examiner*—James R. Hoffman

*Attorney, Agent, or Firm*—Smith, Harding, Earley & Follmer

[57] ABSTRACT

A process for lacquer finishing of open-grain woods such as mahogany, comprising the steps of forming, within the pores of the wood, a film substantially insoluble in lacquer thinner, and thereafter applying lacquer, whereby gas bubbles located within the pores of the wood are unable to rise to the surface of the wood and form blisters.

7 Claims, 4 Drawing Figures

WOOD FINISHING PROCESS

BRIEF SUMMARY OF THE INVENTION

This invention relates to a process for the prevention of blistering in the lacquer finishing of open-grain woods such as mahogany and the like; and to washcoat compositions useful for carying out the process.

In general, lacquer finishing is accomplished by a five step process comprising the steps of applying stain, washcoat, filler, lacquer sealer and topcoat lacquer.

In the first step, a stain, typically a stain of the NGR (non-grain raising) type, is applied and allowed to dry. In production finishing, stain is normally applied by spraying, and the drying time is typically between ½ and 4 hours.

After the stain is applied and allowed to dry, a washcoat is applied, again by spraying. The conventional washcoat is fundamentally a thin coat of clear lacquer or lacquer sealer. Its purpose is to permit the filler, which is subsequently applied, to be completely removed from the wood surface by wiping. When filler is applied directly over stain, some filler tends to remain on the surface of the wood even after wiping. This remaining filler causes clouding or smudging of the rich color of the stain. The washcoat permits complete removal of the filler from the smooth areas and leaves a clear undertone and a sharp pore contrast.

The next operation, filling, has a two-fold purpose: first to produce a smooth surface in the finish by filling the pores of the wood; and second to enhance the beauty of the wood by making the pattern or figure stand out more clearly. Wood fillers are normally supplied in paste consistency, and are reduced in naphtha for application, which is usually by spraying. The filler is allowed to set until it acquires a flat (non-glossy) appearance. After the filler becomes flat, and before it becomes sticky, the wood is wiped across the grain with a rag to remove the filler from the surface while leaving the pores filled. The filler is then allowed to dry, heat being used in some instances in order to speed the drying process.

After the coloring and filling processes are completed, a lacquer sealer is applied. The purpose of the lacquer sealer is to provide a smooth foundation for the topcoat lacquer. This is accomplished by spraying a coat of lacquer sealer and sanding it smooth after it is dry. Basically, a lacquer sealer is a clear gloss lacquer containing a sanding agent such as zinc stearate to cause the dried sealer coating to cut down more easily and to reduce clogging of the sandpaper.

Finally, the topcoat lacquer is applied. The topcoat lacquer is typically applied by spraying two or three coats over the coating of lacquer sealer. The topcoat lacquer may be either a clear gloss lacquer or a flat lacquer, depending on the desired appearance of the finish. Toughness, mar resistance, rubbing properties and various other important properties of the topcoat lacquer may vary depending on the particular formulation used. A typical topcoat lacquer formulation is the following:

| | % by weight |
|---|---|
| ½ Second R.S. Nitrocellulose | 12.13 |
| Raw Castor Oil | 3.03 |
| Dibutyl Phthalate | 3.03 |
| Maleic Modified Rosin Ester Resin | 7.07 |
| Nonoxidizing Phthalic Alkyd Resin | 10.1 |

-continued

| | % by weight |
|---|---|
| Butyl Acetate | 24.24 |
| Ethanol | 8.08 |
| Butanol | 6.46 |
| Xylol | 25.86 |

The last four ingredients, the butyl acetate, ethanol, butanol and xylol constitute a "lacquer thinner," which is a solvent for the film forming solids. Various lacquer thinner formulations are used, depending on the particular film forming solids in the lacquer and the desired drying properties. Usually in order to achieve optimum properties, a lacquer thinner comprises a mixture of active solvents, latent solvents and diluents. The active solvents, which are usually low molecular weight, oxygen-containing, polar organic solvents such as esters, ketones, some alcohols and glycols and glycol ethers, are present in order to dissolve the nitrocellulose. Latent solvents, which are usually alcohols, are in themselves unsatisfactory solvents for nitrocellulose. However, in appropriate combination with active solvents, they enhance the solvency of a system and thus lower viscosity. The diluents, which are generally either aliphatic or aromatic hydrocarbons do not dissolve or aid in dissolving the nitrocellulose. However, they are used to lower solvent costs by replacing the more expensive, active solvents, and are also useful in dissolving the resins, modifying evaporation rates and in controlling viscosity. In the above example of a typical topcoat lacquer, butyl acetate is the active solvent, ethanol and butanol are present as latent solvents, and xylol is present as a diluent.

One difficulty frequently experienced in lacquer finishing of open-grained wood by the conventional process is known as "blistering." Blistering, also known as "bubbling,38 is characterized by the appearance of small bumps or blisters in the outer coat of lacquer. These bumps or blisters may break in some instances, forming small holes in the finish. Where this occurs, the effect is sometimes known as "pinholing." Blistering does not occur to an objectionable degree at all times, but rather is sporadic, and evidently depends on various factors such as film thickness of the lacquer, moisture, temperature and perhaps other factors as well.

I have discovered that blistering results from the entrapment of air or other gases in the conventional washcoat, and the subsequent solution or softening of the washcoat solids by lacquer thinner from subsequent coats of lacquer or from the sealer. The solution or softening of the washcoat solids causes the entrapped air or other gas to be released in the form of bubbles which tend to rise to the surface of the wood to form blisters in the lacquer finish.

To illustrate the manner in which blisters are believed to be formed in the conventional finishing process, consider a typical washcoat. The solid content of a conventional washcoat might consist, for example, of 40% nitrocellulose, 45% coconut alkyd resin and 15% Dioctyl phthalate (DOP). These solids are dissolved in lacquer thinner to produce a 10% solution. Zinc stearate is added in an amount equal to approximately 5% based on the weight of the above solids, and is present as a sanding aid. The filler, which is applied following the washcoat, typically comprises a combination of a pigment, a binder, and other solids, a typical filler formula being as follows:

| | % by weight |
|---|---|
| Silica | 38.46 |
| Barytes | 23.08 |
| Magnesium Silicate | 11.54 |
| Aluminum Stearate | 1.69 |
| Burnt Umber | 2.85 |
| Linseed Oil | 5.08 |
| Filler Varnish | 17.30 |

One consideration in the choice of ingredients in the filler is the solubility of the binder. Theory indicates a binder that is highly resistant to lacquer solvents. However, this conflicts with the need for solubility and stability of the filler when thinned in naphtha for spray application. Normally, therefore, the binder used in fillers formulated for spray application is soluble in lacquer thinner. The solidified filler in the pores of the wood is somewhat porous. Because of this and also by reason of the solubility of its binder, the filler is pervious to lacquer thinner. As the subsequent sealing and lacquer coats are applied, the lacquer thinner tends to pass through the filler, and the active solvents in the lacquer thinner, such as butyl acetate or methyl ethyl ketone, dissolve or soften the nitrocellulose in the film formed by the washcoat. The solution or softening of the washcoat film causes entrapped air or gas to be released in bubble form, and blistering frequently results.

The process in accordance with the invention eliminates blistering by producing a film which is substantially insoluble in lacquer thinner. The finishing process in accordance with the invention comprises the steps of applying a stain to an open-grained wood such as mahogany or the like, thereafter applying at least one coat of lacquer, the lacquer comprising a quantity of film-forming solids dissolved in a thinner, and is characterized by the step of applying a washcoat, following the application of stain but preceding the application of filler, to form within the pores of the wood a film substantially insoluble in the particular thinner used in the subsequent lacquer coats.

The film formed by the washcoat traps air or other gases within the pores as does the film of the conventional washcoat. However, as the film is insoluble in the thinner of the particular lacquer used in subsequent coats, the film does not dissolve or soften. Consequently, the gas bubbles located within the pores of the wood remain trapped, and are unable to rise to the surface of the wood and form blisters in the lacquer finish.

The principal object of the invention is to provide a lacquer finishing process which effectively eliminates blistering, thereby reducing the necessity for rework and increasing production in furniture factories and wherever lacquer finishing is carried out. Other objects of the invention will be readily apparent from the following detailed description.

DETAILED DESCRIPTION

The Best Mode

Figure 1:
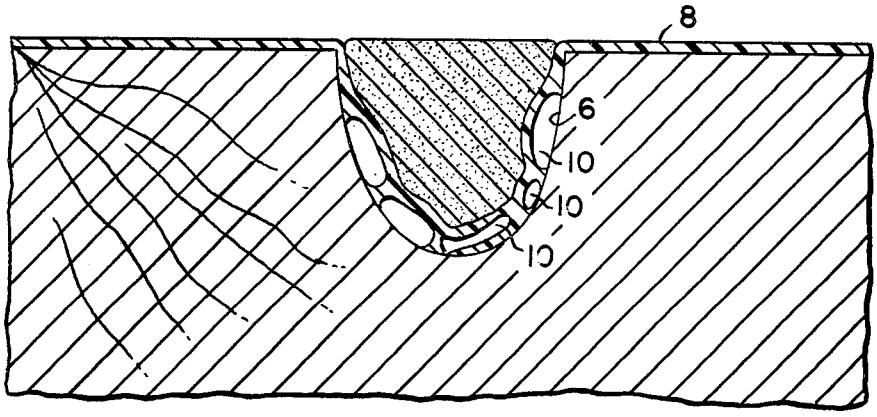
FIGS. 1, 2, 3 and 4 are typical cross-sectional views of pores in mahogany veneer, illustrating the entrapment of gas bubbles by the washcoat, each section being taken on planes disposed perpendicular to the surface of the wood and transverse to the larger dimension of the pore.

The preferred lacquer finishing process in accordance with the invention is carried out by using a nitrocellulose-based washcoat formula, nitrocellulose being used primarily because it promotes rapid drying of the washcoat film. This rapid drying characteristic is due in part to fast solvent release, and also in part to the fact that the unsubstituted hydroxyl groups in the nitrocellulose are able to react rapidly with the cross-linking agent, which is present in the preferred washcoat formula as described below.

To produce a washcoat film which is substantially insoluble in the active solvents such as butyl acetate, methyl ethyl ketone, etc. of the thinner in the subsequently applied lacquer coats, the solid components are chosen so that cross-linking takes place as the washcoat dries. The washcoat film which is ultimately formed is a cross-linked polymer, which is highly resistant to active solvents for nitrocellulose-based lacquers.

The second component of the solids in the preferred washcoat is a styrene-allyl alcohol copolymer, which has an abundance of primary hydroxyl groups providing reactive sites for forming cross-linked polymers.

The third component of the solids is an organic titanate having isopropoxy reactive sites. The titanate reacts with the free hydroxyl groups of the nitrocellulose and the styrene-allyl alcohol copolymer to produce a cross-linked structure. The organic titanate is preferred as a cross-linking agent because it does not affect the color of the stain applied in the step preceding the application of the washcoat.

Free hydroxyl groups in the wood substrate itself also react with the isopropoxy groups of the titanate. This reaction contributes both to the chemical resistance and to the adhesion of the washcoat film.

A non-drying alkyd resin such as a coconut alkyd is optional, but is used in the solids of the preferred washcoat in order to impart flexibility to the washcoat film and to improve adhesion. It also has carboxyl reactive sites which contribute to cross-linking in the film.

The nitrocellulose is preferably present as about 12 – 40% (by weight) of the solids. Hercules R.S. grade nitrocellulose having a viscosity of ½ sec. and supplied as 70% solids is an example of a suitable nitrocellulose for use in formulating the washcoat.

The styrene-allyl alcohol copolymer is preferably present as about 27 – 55% (by weight) of the solids. Monsanto "RJ-100" is an example of a suitable copolymer.

The non-drying alkyd resin can be present in any amount from 0 to 18% (by weight). Larger amounts can be used, but little is accomplished in the way of improvement in flexibility and adhesion by amounts exceeding 18%. Beckosol P-222-60, made by Reichhold Chemical Industries is an example of a suitable nondrying alkyd resin.

In order to eliminate blistering consistently the organic titanate should be present in the washcoat in an amount not less than about 17% (by weight) of the total solids. Preferably it is present as 17% to 30% of the solids. Amounts of organic titanate greater than 30% can be used, but produce no discernible beneficial results. "Tyzor AA," available from DuPont, is an example of a suitable organic titanate cross-linking agent.

The solvent system for the washcoat preferably resembles that for any conventional washcoat, and comprises active solvents, latent solvents and diluents, chosen with the following criteria in mind: (a) compatibility with the solids; (b) the desired viscosity; (c) the desired volatility; i.e. the ability of the solvent to leave the film at a desired rate without affecting the properties of the film; and (d) the absence of objectionable odor. Where the washcoat is to be supplied as a single package system, it is desirable to include a quantity of alcohol in the solvent system, as the presence of alcohol in the solvent system tends to prevent cross-linking from taking place in solution. This may be due to the fact that the cross-linking of the organic titanate with the alcohol, hydroxyl groups involves the separation of isopropyl slcohol, which is inhibited by the presence of alcohol in the solvent system. The washcoat, when supplied as a single package system, has a shelf life greater than 2 months, which is satisfactory for industrial finishing. The washcoat may, of course, be supplied as a two-part system, the cross-linking agent being supplied separately from the other ingredients, and being added by the user immediately prior to application.

This washcoat produces a film having excellent adhesion and clarity, and does not adversely affect the color of the previously applied stain. The solvent-resistance of the washcoat film develops rapidly following its application, so that the interval between the washcoat application and the first lacquer coat (usually lacquer sealer) can be quite short without risking the formation of blisters. The film dries rapidly, and therefore can be used in industrial finishing as a direct replacement for a conventional nitrocellulose-based washcoat without the need for any change in the usual finishing schedule.

An example of a specific washcoating formula and procedure in accordance with the preferred embodiment of the invention is as follows:

EXAMPLE 1

An excellent washcoat formula comprises the following solids by weight:

24.5% nitrocellulose
43.0% styrene-allyl alcohol copolymer
9.3% coconut alkyd resin
23.2% Tyzor AA organic titanate and a solvent comprising the following components by weight:
17% methyl ethyl ketone
12% butyl acetate
7% methyl-n-butyl ketone
14% isopropyl alcohol
17% toluene
33% xylene (The xylene used is a technical grade consisting of 17% p-xylene, 45% m-xylene, 18% o-xylene and 20% ethylbenzene.) The solids constitute about 14% of the total weight of the washcoat formula.

An open-grain wood, such a mahogany, is first stained and allowed to dry. The washcoat just described is then applied by spraying, preferably to a film thickness of between 3 and 4 wet mils. The washcoat is then allowed to air dry for at least about ¾ hour before filling, or alternatively heat is applied to accelerate drying. The washcoat film is then scuff sanded with #220 stearated paper. Then, filler, as described above, is applied and padded well into the pores of the wood. Filler is either allowed to air dry overnight, or baked for about one hour at a temperature of about 120° F. Lacquer coats comprising a first coat of lacquer sealer followed by three coats of topcoat lacquer are then applied. The lacquer thinner in the lacquer coats is about 38% butyl acetate active solvent. This procedure produces consistently blister-free films.

Alternative Modes

An example of an alternative lacquer finishing process in accordance with the invention utilizes a washcoat which forms a film in which a vinyl copolymer is cross-linked with urea formaldehyde resin. Union Carbide VAGD is a partially hydrolyzed vinyl chloride-vinyl acetate copolymer which can be used. Reichhold Beckamine 3530-50 urea formaldehyde is used as the other major component of the washcoat solids. The vinyl chloride-vinyl acetate copolymer cross-links with the urea formaldehyde under the influence of an acid catalyst. Mobil Chemical PA75 organic acid phosphate is preferred because, when used with the vinyl/urea mixture, it produces a fast cure, but does not gel the washcoat as it is being used. PA-75 is a 75:25 mixture of phenyl acid phosphate in butyl alcohol. The washcoat also contains a surfactant to eliminate foam and to assist in flow and levelling of the coating. Troykyd Anti-Float Liquid is a suitable surfactant, and is manufactured by Troy Chemical Company.

EXAMPLE 2

The washcoat contains the following solids by weight (classifying the surfactant and catalyst as solids for the sake of convenience):

47% vinyl chloride-acetate copolymer
47% urea formaldehyde
4% phenyl acid phosphate/butyl alcohol
2% surfactant and a solvent comprising the following components by weight:

41% toluene
44% methyl-n-butyl ketone
15% isobutanol

The solids constitute about 14% of the total weight of the washcoat formula.

The procedure for application is the same as that given in Example 1.

Another alternative process is based upon the formation of a highly cross-linked polyurethane washcoat film by the reaction of a polyisocyanurate of toluene diisocyanate with a polyester resin. This washcoat formula produces excellent results, but has the disadvantage that the polyisocyanate and the polyester resin must be stored separately, and must be mixed together immediately prior to spraying the washcoat. In the following specific example, the polyisocyanurate of toluene diisocyanate is Desmodur IL, and the polyester resin is Desmophen 1100, both manufactured by Mobay Chemical Company. The resistance of the polyurethane film to solvents in subsequent washcoats depends on cross-linking. By way of contrast, polyrethane films having a low degree of cross-linking cannot be expected to exhibit sufficient solvent resistance to prevent blistering consistently.

EXAMPLE 3

The polyester component is a 16% solution of polyester resin in a solvent mixture consisting of equal parts of ethyl acetate, methyl isobutyl ketone, methyl ethyl ketone, and xylene (the composition of which is given in Example 1).

The polyisocaynate component known by the trademark Desmodur IL is supplied with a butyl acetate solvent, so that the solution is about 50% solids.

The finishing process is as described in Example 1, except that the polyester component and the polyisocyanate components are mixed in a ratio of 89:11 immediately prior to spraying.

While the specific examples given above depend upon cross-linking for the formation of a solvent-resistant washcoat film to eliminate blistering, it is also possible to eliminate blistering by utilizing washcoat compositions the solids of which, when in the form of a dry film, are inherently substantially insoluble in lacquer thinner mixtures.

In the following specific example, a mixture of acrylic resins is used. Rohm and Haas Acryloid A-101 is an extremely hard and highly solvent-resistant methyl methacrylate polymer, supplied as 40% solids in methyl ethyl ketone. The statement that the solids are substantially insoluble and the statement that A-101 is supplied in MEK, while apparently contradictory, are not so in fact. Solubility depends in a large measure on time of exposure. Acryloid A-101 is very difficult to dissolve in MEK, but it will dissolve if enough time is provided. On the other hand a dried film composed of or containing a large proportion of A-101 is not readily attacked by MEK or other solvents contained in subsequently applied lacquer coats because the MEK or other solvents evaporate before they have time to penetrate the film. The term "substantially insoluble," as used herein with reference to a film and a thinner is intended to mean that the thinner, when applied as part of a lacquer coat over the film, evaporates substantially completely before it has an opportunity to permeate through the film.

Conchemco, Inc. Thermoplastic Acrylic Resin 311-405 is an acrylic copolymer, present in order to produce good film adhesion and to produce a film which is not excessively brittle as would be the case if Acryloid A-101 were used alone. The presence of Acrylic Resin 311-405, therefore, prevents cold checking and loss of adhesion.

Dioctyl phthalate is also present as a plasticizer, and its main purpose is to increase the flexibility of the washcoat film, without sacrificing too much hardness, while maintaining a high degree of solvent resistance.

This formula, while capable of producing satisfactory results, produces a washcoat film which is attacked to a somewhat greater degree than the cross-linked films described above. Hence, if exposed to excessive quantities of solvents in subsequent lacquer coats, the film may be permeated. Clarity of the film is satisfactory for most finishing purposes, but not as good as that of the films produced in accordance with the preceding examples.

EXAMPLE 4

The washcoat contains the following solids by weight:

53% Acryloid A-101 (solids only)
33% Acrylic Resin 311-405 (solids only)
14% Dioctyl phthalate and a solvent comprising the following components by weight:

17% isobutanol
17% isopropanol
17% butyl acetate
7% ethylene glycol monoethyl ether
23% toluene 19% methyl ethyl ketone The solids constitute approximately 14.0% of the total weight of the washcoat.

The finishing procedure is the same as that given in Example 1.

Each of the washcoat formulas described above produces a washcoat film which is capable of being applied by spraying and which permits the complete removal of excess filler from the surface of the wood. The washcoat films produced by these formulas, however, unlike conventional washcoat films, are substantially insoluble in conventional lacquer thinners. That is, they are not permeated by the lacquer thinners when applied as part of a lacquer coat. These films are highly resistant to active solvents such as esters and ketones or by the various alcohols, glycols or glycol ethers sometimes used in lacquer thinners. In addition, they are resistant to latent solvents such as ethanol or butanol and to the various aliphatic and aromatic hychrocarbons which are used as diluents. Consequently, once the washcoat film is dry, air or gas bubbles which form within the pores of the wood are permanently trapped under the washcoat film, and are not released by reason of the softening or solution of the washcoat film by the thinners of the subsequently applied lacquer coats. The manner in which gas bubbles are permanently entrapped within the pores of the wood is illustrated in the accompanying drawings.

In FIG. 1, the boundary of a large open pore is indicated at 6. The washcoat forms a thin film 8 on the surface of the wood, and the film extends into the pore, coating the pore boundary 6, and at the same time entrapping air bubbles 10. Paste filler occupies the remainder of the space within the pore. As the paste filler is porous and its binder is soluble in lacquer thinner, the thinner in the subsequently applied lacquer coats finds its way through the filler to the washcoat film, and will either soften or dissolve a conventional washcoat film, allowing the air bubbles to rise through or around the porous filler to produce objectionable blisters or pinholes in the lacquer coats on the surface of the wood. The washcoat films produced as described above, however are highly resistant to lacquer thinner, and the bubbles remain entrapped as shown in FIG. 1. The washcoat film on the surface of the wood, however, serves its intended purpose in that it allows the filler to be removed from the surface readily by wiping.

Figure 2:
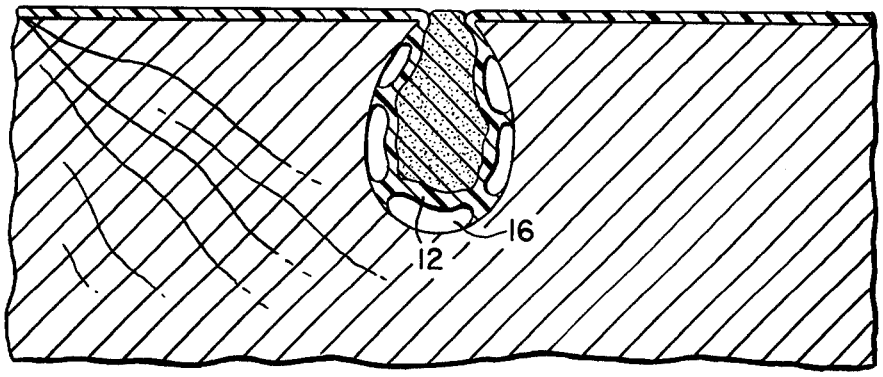
Figure 3:
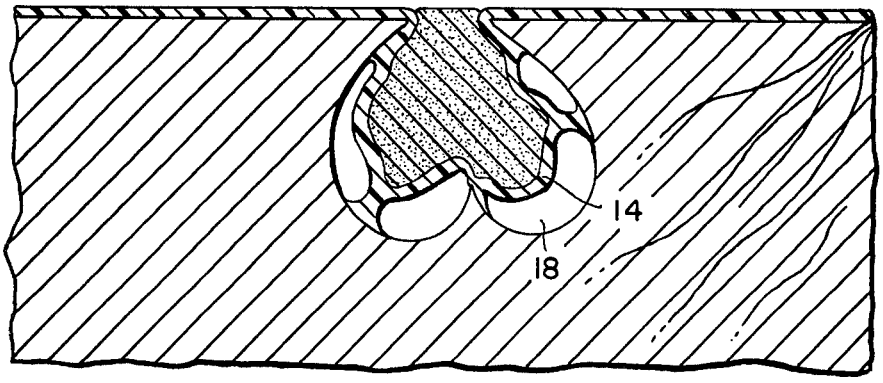

Frequently open-grain woods have pores which have relatively narrow openings at the surface of the wood and relatively large subsurface cavities. In such pores, as illustrated in FIGS. 2 and 3, the washcoat film has a tendency not to follow the contour of the cavity and instead bridges the cavity in some areas, e.g. at 12 in FIG. 2 and at 14 in FIG. 3. When bridging occurs, large pockets of entrapped air are produced such as those shown at 16 and 18. These large pockets of air are responsible for some of the more serious blistering effects which are sometimes observed. Here again, the insolubility of the washcoat film at the locations of the bridges causes the air pockets to remain permanently entrapped so that the air bubbles cannot rise to the surface and blister the lacquer coats.

Figure 4:
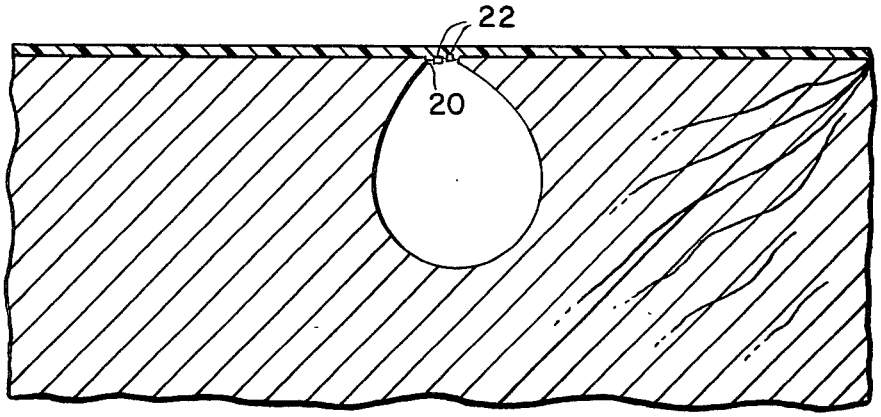

Occasionally, the pores have extremely narrow openings, such as opening 20 in FIG. 4. Frequently, these openings are partially bridged by wood splinters, such as splinters 22, and because of the presence of these splinters and the narrow width of the opening, neither washcoat nor filler is able to enter the opening. A conventional washcoat film completely bridges the opening of the pore, solidifying the layer of splinters and entrapping a large pocket of air in the cavity. Here again, lacquer thinners tend to dissolve the conventional washcoat film on the surface of the wood, and enter the cavity, displacing air in the cavity and producing blisters in the lacquer film. Where a washcoat formula which forms a film substantially insoluble in lacquer thinner is used, however, the lacquer in the subsequently applied coats is not able to enter the cavity, and blister formation is prevented.

While the process described herein is particularly useful in the lacquer finishing of mahogany, it can be used to advantage in the lacquer finishing of various other open-grain woods, such as oak, pecan, elm, ash, bubinga, iroko, padouk, purpleheart, rosewood and walnut, all of which are subject to occasional blistering.

While I have described a number of specific formulas, persons skilled in the art will recognize that they can make various departures from the specific formulas described while still obtaining the benefits of blister-free films produced in accordance with the invention. While the washcoat formulas as described herein produce films which are highly resistant to conventional lacquer thinners, those skilled in the art will also recognize that the essential aspect of the invention lies in the relationship between the washcoat film and the particular lacquer thinner used, and that variations in the washcoat formula may be required where non-conventional lacquer solvents are used.

I claim:

1. A process for finishing open-grain wood comprising the steps of: applying a paste filler to the wood; and thereafter applying at least one coat of lacquer, the lacquer, at least in the first coat thereof, comprising a quantity of film-forming solids dissolved in a thinner, and the filler being pervious to said thinner; characterized by the step of applying a washcoat in a substantially non-aqueous volatile solvent, preceding the application of filler, to form on the surface of the wood and within pores of the wood a film substantially insoluble in said thinner; whereby gas bubbles located within the pores are unable to rise to the surface of the wood and form blisters in the lacquer film.

2. A process according to claim 1 in which the step of forming a film is carried out by applying a washcoat containing nitrocellulose.

3. A process according to claim 1 in which the step of forming a film is carried out by applying a washcoat having at least two components which cross-link during the drying of the washcoat to form said substantially insoluble film.

4. A process according to claim 1 in which the step of forming a film is carried out by applying a washcoat comprising nitrocellulose, a styrene-allyl alcohol copolymer and a cross-linking agent.

5. A process according to claim 1 in which the step of forming a film is carried out by applying a washcoat comprising nitrocellulose, a styrene-allyl alcohol copolymer and an organic titanate, in a solvent.

6. A process according to claim 1 in which the step of forming a film is carried out by applying a washcoat having at least one component which cross-links with the free hydroxyl groups in the wood itself.

7. A process according to claim 1 in which the step of forming a film is carried out by applying a washcoat having at least two components which cross-link during the drying of the washcoat to form said substantially insoluble film, at least one of said components also cross-linking with the free hydroxyl groups in the wood itself.

* * * * *